US010466004B2

(12) United States Patent
Walker

(10) Patent No.: US 10,466,004 B2
(45) Date of Patent: Nov. 5, 2019

(54) OPTIMIZED FLOW COMPENSATOR

(71) Applicant: Drew Nolle Walker, Mesa, AZ (US)

(72) Inventor: Drew Nolle Walker, Mesa, AZ (US)

(73) Assignee: Drew Nolle Walker, Mesa, AZ (US)

( * ) Notice: Subject to any disclaimer, the term of this patent is extended or adjusted under 35 U.S.C. 154(b) by 398 days.

(21) Appl. No.: 15/232,178

(22) Filed: Aug. 9, 2016

(65) Prior Publication Data

US 2017/0160036 A1 Jun. 8, 2017

Related U.S. Application Data

(60) Provisional application No. 62/203,552, filed on Aug. 11, 2015.

(51) Int. Cl.
*F41A 21/36* (2006.01)

(52) U.S. Cl.
CPC ..... *F41A 21/36* (2013.01)

(58) Field of Classification Search
CPC ..... F41A 21/36; F41A 21/30; F41A 21/325; F41A 21/28; F41A 1/08; F41A 21/32; F41A 13/08; F41A 25/26; F41A 27/00; F41A 35/00; F41C 27/00
USPC ..... 89/14.3
See application file for complete search history.

(56) References Cited

U.S. PATENT DOCUMENTS 817,134 A * 4/1906 Smith ..... F41A 21/36 89/14.3
1,259,251 A * 3/1918 Love ..... F41A 21/30 181/223
1,390,658 A * 9/1921 Towson ..... F41A 21/36 89/14.3
1,555,026 A * 9/1925 Rose ..... F41A 21/36 89/14.3
1,763,286 A * 6/1930 Wilman ..... F41A 21/30 137/614.17
2,088,380 A * 7/1937 Methlin ..... F41A 21/36 89/14.3
2,184,595 A * 12/1939 Hughes ..... F41A 21/36 89/14.3
2,449,571 A * 9/1948 Walker ..... F41A 21/36 89/14.4
2,457,802 A * 1/1949 Bauer ..... F41A 21/30 89/1.7
2,499,428 A * 3/1950 Tiffany ..... F41A 21/36 89/14.3
D158,796 S * 5/1950 Powell ..... 42/79
(Continued)

*Primary Examiner* — Joshua E Freeman
*Assistant Examiner* — Bridget A Cochran
(74) *Attorney, Agent, or Firm* — Lerner, David, Littenberg, Krumholz & Mentlik, LLP

(57) ABSTRACT

A firearm compensator, to be affixed to the muzzle of a gun for reducing at least one of flash and recoil, utilizes a vectored flow nozzle, an expansion chamber containing a prominent thrust surface and flow-directing structures below the barrels center line, and flash-hiding ports. A compression ramp containing dimple-like structures connects the bottom of the gun muzzle to the bottom of the prominent thrust surface. Upon firing the gun, gasses depart from their linear trajectory as they flow past the vectored flow nozzle, flow diagonally downward past a dimpled compression ramp in the expansion chamber, and strike the thrust surface. A plurality of substantially horizontal elongated ports in the expansion chamber aids in flash suppression.

17 Claims, 11 Drawing Sheets

(56) References Cited

U.S. PATENT DOCUMENTS 2,567,826 A * 9/1951 Prache ..... F41A 21/36 89/14.3
2,625,235 A * 1/1953 Caulkins ..... F16L 55/04 137/625.28
2,796,005 A * 6/1957 Shapel ..... F41A 21/36 89/14.3
2,809,560 A * 10/1957 Matson ..... F41A 21/325 89/14.3
2,859,663 A * 11/1958 Irbitis ..... F41A 21/32 89/14.3
2,966,682 A * 1/1961 Henning ..... B25C 1/188 227/8
3,152,510 A * 10/1964 Ashbrook ..... F41A 21/36 89/14.3
3,177,771 A * 4/1965 McKim ..... F41A 21/36 89/14.3
3,368,453 A * 2/1968 Shaw ..... F41A 21/36 89/14.3
3,492,912 A * 2/1970 Clifford ..... F41A 21/36 181/223
3,707,899 A * 1/1973 Perrine ..... F41A 21/36 89/14.3
3,714,864 A * 2/1973 Thierry ..... F41A 21/38 89/14.3
4,307,652 A * 12/1981 Witt ..... F41A 21/36 89/14.3
4,436,017 A * 3/1984 Mohlin ..... F41A 21/36 89/14.3
4,459,895 A * 7/1984 Mazzanti ..... F41A 21/36 89/14.3
4,545,285 A * 10/1985 McLain ..... F41A 21/36 89/14.3
4,583,445 A * 4/1986 Blair ..... F41A 21/36 89/14.2
4,691,614 A * 9/1987 Leffel ..... F41A 21/36 89/14.3
4,852,460 A * 8/1989 Davidson ..... F41A 21/36 89/14.05
4,879,942 A * 11/1989 Cave ..... F41A 21/36 89/14.3
4,930,396 A * 6/1990 Johnson ..... F41A 21/36 89/14.3
5,123,328 A * 6/1992 Schuemann ..... F41A 21/28 89/14.3
5,367,940 A * 11/1994 Taylor ..... F41A 21/36 89/14.3
5,385,079 A * 1/1995 Cave ..... F41A 21/34 89/14.3
D358,861 S * 5/1995 Gangl, Jr. ..... D22/108
5,476,028 A * 12/1995 Seberger ..... F41A 21/36 89/14.3
5,652,406 A * 7/1997 Phan ..... F41A 21/36 89/14.3
5,675,107 A * 10/1997 Ledys ..... F41A 21/36 89/14.05
5,685,102 A * 11/1997 Latka ..... F41A 21/325 42/76.01
5,753,846 A * 5/1998 Koon ..... F41A 21/28 42/75.02
6,269,727 B1 * 8/2001 Nigge ..... F41A 21/36 89/14.3
6,308,608 B1 * 10/2001 Eisenman ..... F41A 21/32 89/14.2
6,425,310 B1 * 7/2002 Champion ..... F41A 21/30 89/14.3
6,536,324 B1 * 3/2003 Boissiere ..... F41A 25/20 89/14.3
6,578,462 B1 * 6/2003 Franchino ..... F41A 21/36 89/14.2
6,595,099 B1 * 7/2003 Olson ..... F41A 21/34 89/14.2
6,880,444 B2 * 4/2005 Ang ..... F41A 21/30 89/14.3
7,032,339 B1 * 4/2006 Bounds ..... F41A 21/36 42/1.06
7,194,836 B1 * 3/2007 Urban ..... F41C 27/22 42/106
7,296,505 B2 * 11/2007 Balbo ..... F41A 21/325 89/14.05
7,836,809 B2 11/2010 Noveske
8,087,337 B1 * 1/2012 Cary ..... F41A 21/36 89/14.3
8,112,931 B2 * 2/2012 Yost ..... F41A 21/40 42/79
8,424,440 B1 * 4/2013 Carson ..... F41A 21/36 89/14.3
8,800,419 B1 * 8/2014 Walker ..... F41A 21/36 89/14.3
2003/0106417 A1 * 6/2003 Vais ..... F41A 21/36 89/14.3
2010/0257996 A1 * 10/2010 Noveske ..... F41A 21/34 89/14.2
2010/0269387 A1 * 10/2010 Drajan ..... F41A 21/36 42/1.06
2011/0174141 A1 * 7/2011 Adolphsen ..... F41A 21/02 89/14.3
2012/0228052 A1 * 9/2012 Findlay ..... F41A 21/30 181/223
2013/0025439 A1 * 1/2013 Orton ..... F15C 1/16 89/14.2
2013/0227871 A1 * 9/2013 Stone ..... F41A 21/30 42/76.1
2014/0216237 A1 * 8/2014 Butler ..... F41A 21/36 89/14.4
2015/0001001 A1 * 1/2015 Wilson ..... F41A 21/30 181/223
2016/0033224 A1 * 2/2016 Miller, III ..... F41A 21/36 89/14.2
2016/0123689 A1 * 5/2016 Maeda ..... F41A 21/30 89/14.3
2016/0161203 A1 * 6/2016 Wilson ..... F41A 21/30 89/14.3

* cited by examiner

OPTIMIZED FLOW COMPENSATOR

CROSS-REFERENCE TO RELATED APPLICATIONS

This application claims the benefit of the filing date of U.S. Provisional Patent Application No. 62/203,552 filed Aug. 11, 2015, the disclosure of which is hereby incorporated herein by reference.

FIELD OF INVENTION

This invention relates to the field of recoil-reducing muzzle devices for firearms. More specifically, the invention comprises a vectored flow nozzle and expansion chamber with a means of substantially diverting the main, forward trajectory of gas flow of a gunshot to strike a surface more directly, thereby producing a counterforce to reduce recoil.

BACKGROUND OF THE INVENTION

Muzzle brakes, categorically, are seen as being incompatible with combat, as they are often criticized as causing more problems than they solve. To define terms, muzzle brakes are muzzle devices that are affixed to the end of a firearm's muzzle for the primary purpose of reducing recoil. The term "compensator" is often used synonymously. Regardless, muzzle brakes and compensators feature very conventional designs that branch off very little from two main archetypes. One of the quintessential designs is an open, multi-baffle design featuring one or more surfaces that allow expanding gases to strike, thereby imparting an indirect, somewhat angled counter-recoil force. Most gases exit this type of design laterally outward to the sides of the compensator and strike the cooler air of the outside atmosphere all at once, causing a bright flash and concussion felt by the shooter and those nearby. These designs often vary in the number of baffle chambers or in the tolerance allowed for each bullet to pass through during its flight, but they work under the same design principles. Designs featuring upward-facing ports demonstrate another design architype. These devices utilize jets of expanding gases firing upward to produce a force to counteract the upward movement of the muzzle. The result is lessened muzzle rise but also a blinding flash appearing directly in the shooter's immediate field of view. Both types of designs allow gases to expand into ports or open baffle chambers and do nothing to bend or substantially alter the primary, forward trajectory of the gases from a gunshot. In short, they leverage the property of expansion alone.

BRIEF SUMMARY OF THE INVENTION

Briefly described, aspects of the present invention may provide an improved recoil-reducing apparatus in front of the muzzle of a firearm. It is an aspect of this invention to provide a highly efficient anti-recoil apparatus that addresses both horizontal and vertical recoil simultaneously. It is another aspect of this invention to minimize back-blast and flash experienced by the shooter. These aspects of the invention are accomplished utilizing a vectored flow nozzle, an expansion chamber, substantial anti-recoil surfaces, compression, strategically-placed ports, dimpled surfaces, ports, and exit recess prongs.

It is an aspect of this invention to more efficiently use the force contained in the primary, forward trajectory of a gun's gases in a way that alters that trajectory and generates a counter-recoil force as a result. An embodiment of the present invention utilizes a vectored flow nozzle positioned in front of the muzzle (and there are many means of attachment including muzzle engagement via threads or even over another muzzle device as a "quick-detach" mount) and a prominent, primary anti-recoil surface inside an expansion chamber to provide an enhanced means of using hot, expanding gases from a gunshot to impart more forces onto a baffle-like counter-recoil surface by changing the trajectory of the gases. The shape of the vectored flow nozzle may be aptly described as a short section of bent conduit or angled throat which actively guides the gases escaping from a firearm's muzzle away from their straight, longitudinally forward trajectory. The vectored flow nozzle is positioned very closely against the muzzle of the gun, yet is part of the compensator; this close proximity allows the vectored flow nozzle to interact with the gases before they get much chance to expand. Dimensionally, the space between the walls of the vectored flow nozzle is large enough to allow the projectile to pass through untouched. Upon firing, the gunshot's hot, expanding gases leave the firearm's muzzle, enter the compensator, are deflected by the vectored flow nozzle from their initial trajectory (i.e. expanding and traveling straight forward, coaxial to the gun's barrel) to their new trajectory (i.e. expanding and traveling forward but now at a lowered angle, downward from the centerline of the gun's barrel). This new trajectory aims the gases more directly at one or more prominent counter-recoil surfaces within the expansion chamber immediately following the vectored flow nozzle. Conversely, the projectile, due to its stabilization (for example, from the spin imparted from the firearm's rifling), continues along its straight pathway along the barrel's centerline axis unchanged by the vectored flow nozzle and exits the compensator safely. The present compensator's expansion chamber is positioned in front of the vectored flow nozzle; this expansion chamber extends beneath the centerline of the barrel and is defined by generally planar side-walls, a ceiling, a primary counter-recoil surface, a compression ramp connecting the vectored flow nozzle and the bottom of the primary anti-recoil surface, and a front wall in an exemplary embodiment. Once the gases pass through the vectored flow nozzle, they flow forward and downward along the compression ramp (the floor directly connecting the vectored flow nozzle and the bottom of the primary anti-recoil surface), which compresses the gases—the compression ramp acts as an anti-recoil surface in itself. Gases strike the counter-recoil surface, and impart a greater force into the primary anti-recoil surface than were they merely allowed to stay on their initial, original trajectory and expand into the counter-recoil surface. Furthermore, the front wall of the invention which contains the departure recess where the bullet exits may also be substantially curved or angled to increase forces that lower muzzle rise in an exemplary embodiment.

To enhance the change in primary gas trajectory, dimples or ridges may be included on the exemplary embodiment on the compression ramp laterally forward of the vectored flow nozzle. The dimples, similar to those on a golf ball, interact with gas flow and alter the boundary layer between laminar flow and turbulent flow. The gases rush by the compression ramp on their way to collide with the primary anti-recoil surface on the far end of the expansion chamber positioned beneath the centerline axis of the barrel. With dimples (it should be noted that these may take the form of ridges or similar artifacts—the term dimples may denote either dimples or other similar features and should be considered synonymous) on the compression ramp, the gases rush by more closely to the compression ramp's surface. The result is a greater change in the primary trajectory of the gases allowing a more direct collision with the primary anti-recoil surface. In an exemplary embodiment, the primary anti-recoil surface may be a curved surface to maximize surface area. In an alternative embodiment, the primary anti-recoil surface may be a substantially straight, angled surface to maximize the degree to which the gases strike the anti-recoil surface head-on.

To further enhance the change in primary gas trajectory, one or more interior thrust beams may be provided within the expansion chamber. An interior thrust beam spans the internal width of the expansion chamber and provides numerous benefits. These benefits include, for example, providing the gases an additional surface to thrust against, providing structural support for the compensator itself, and providing the gases a structure that may directly influence their trajectory as they rush into the expansion chamber. The interior thrust beam may take the shape of an inverted airfoil, for instance, in an alternative embodiment of the invention, wherein that shape is employed to leverage fluid dynamics and create a net downward force, thereby mitigating muzzle rise. Furthermore, internal thrust beams may complement or be used in place of the vectored flow nozzle, depending upon the embodiment. In an exemplary embodiment of the invention, multiple interior thrust beams are used to direct gases toward the primary anti-recoil surface to maximize the net counter-recoil forced generated.

It is another aspect of the invention to reduce flash. Very closely related to flash reduction, it is another aspect of the invention to reduce back-blast as felt by the shooter. The vectored flow nozzle forces the gas to take a longer route through the expansion chamber due to its new trajectory (diagonally forward and downward is longer than its traditional straight forward trajectory), giving these gases more opportunity to mix with the ambient air within the expansion chamber—more exposure to air within the expansion chamber has the effect of slowing the gases down more prior to exiting the compensator (reducing gas plumes from gas striking outside air). Furthermore, the vectored flow nozzle prevents most gas from exiting the compensator via the departure recess—thereby further mitigating any flash in the shooter's field of view. The expansion chamber further comprises a plurality of elongated, approximately horizontal ports on the lateral side walls of the expansion chamber proximal to the anti-recoil surface. Theses ports allow for oxygen exposure to the under-oxygenated gases flowing through the expansion chamber, thereby allowing an opportunity for combustion to begin internally, rather than allowing gases to be exposed to fresh oxygen only after departing from the compensator.

Furthermore, these ports allow some expanding gases to bleed off and exit the compensator in such a way that does not cause a plume once gas strikes the air of the outer atmosphere, thereby further minimizing flash. Gases exiting the compensator through these ports are allowed to exit in a manner that minimizes their presence in the shooter's field of view. In the compensator's preferred embodiment, these ports are positioned proximal to the primary anti-recoil surface and angled surfaces connected to the ports on their leading edges called bleed ramps. These bleed ramps provide guidance for gases as they exit the compensator via the ports. The bleed ramps send gases laterally outward and longitudinally forward from the compensator, in a diagonal direction. This imparts a direction to the exiting gases that moves them away from the shooter, while also forcing gases to exit in a controlled fashion, thereby minimizing concussion. Because gases strike different parts of the expansion chamber at different times, the bleed ramps force gases to take a pre-determined course—a course which, due to the nature of fluid dynamics, becomes one that gases approaching the ports also take as a result (in essence gases follow the trajectory of the preceding gas ahead of it). In terms of gas flow, some gas will exit via the ports, while other gas is simultaneously striking the primary anti-recoil surface. Once the gas has struck this surface, the gas flows along the path of the gases that have already just exited the compensator, thereby influencing the path of the gases that would otherwise reflect back at the shooter. Instead, these gases exiting via the ports exit laterally outward and longitudinally forward from the ports (as opposed to laterally directly to the side, or worse, back at the shooter).

In another embodiment of the invention, ports may be placed on the ceiling on the invention to maximize the production of downward forces that combat muzzle rise. Interestingly enough, due to the volume of the expansion chamber, ports placed on the ceiling of the compensator not only allow fresh oxygen to enter the expansion chamber causing an increased likelihood of having any flash or combustion contained within the compensator internally, but also allow the hot gases of the gun shot to bleed off into the atmosphere in such a way that minimizes the opportunity for under-oxygenated gases to strike the outer atmosphere all at once and flash. The shape of the compensator allows for ceiling ports to further increase forces that lower muzzle rise while also minimizing flash. Ports may be placed close to or distant from the front wall containing the departure recess depending on the desired effect that is to be achieved. Ports further away from the front wall serve more, for example, to introduce oxygen to the expansion chamber, to reduce flash, and to provide moderate muzzle climb reduction whereas ports proximal to the front wall provide, for example, more muzzle climb reduction. Furthermore, ports arranged away from the front wall may extend to the side walls to further introduce oxygen to the expansion chamber.

Additionally, in yet another embodiment of the invention, ports in the form of substantially forward-facing vents may be positioned on the primary anti-recoil surface as well as on the front wall, whether curved or angled, in an effort to diffuse gases forward, in front of the compensator, thereby lowering the internal pressure of the expansion chamber when hot gases are rushing through it and diffusing the blast forward. Such ports may be angled slightly upward to impart a downward force. To further decrease internal pressure within the expansion chamber, ports, comprising various port shapes, may be placed proximal to the approximately planar side walls of the compensator.

In another embodiment of the invention, flash reduction and back-blast reduction can be further mitigated by an internal structure within the expansion chamber, called the internal flow mound. The internal flow mound is positioned above the centerline axis of the barrel on the ceiling of the expansion chamber, proximal to the front wall of the compensator. Essentially, the internal flow mound is a structure that decreases the total internal height of the expansion chamber. When gases strike the primary anti-recoil surface, some gases that do not exit the compensator via ports or the exit recess begin to travel upward, forming a circular pattern, or eddy, within the expansion chamber. If another shot is fired within close enough succession while the gases forming an eddy pattern remain within the expansion chamber, the subsequent shot's gases may expel from the compensator far more gases than would come from a single shot—the result is an increased flash and back-blast. The internal flow mount decreases the total diameter of the maximum eddy possible within the expansion chamber, thereby decreasing any likelihood of increased flash or back-blast due to internal flow dynamics.

In addition to the above mentioned means for reducing flash and back-blast, an exemplary embodiment of the compensator utilizes and arrangement of prong-like structures surrounding the expansion chamber's bullet departure recess. These prongs interact with the gases exiting the expansion chamber where the bullet exits. Upon striking the outside air these gases begin to form a toroidal shape, or plume. The prongs force the gases beginning to form a plume to flow past and around the prongs, thereby spreading out the gases increasing their exposed surface area and preventing the gases from having the opportunity to ignite all at once causing flash. In its preferred embodiment, the compensator's prong arrangement leaves the very top and bottom areas closed to stop any remaining flash from entering the shooter's field of view or prevent any gases from being channeled downward (during prone shooting gases directed downward will kick up dust and debris). Prongs can further provide a number of additional less obvious benefits that lend themselves readily to combat, such as being sized appropriately to facilitate the attachment of a bayonet or simply provide a means of stabbing or poking (i.e. breaking a window, or prodding enemy personnel).

According to an embodiment, a recoil-reducing apparatus configured to be affixed to a muzzle of a gun having a gun barrel having a longitudinal axis comprises a muzzle engagement recess configured to be positioned coaxial to and longitudinally forward of the gun barrel, a vectored flow nozzle positioned coaxial to and longitudinally forward of the muzzle engagement recess, and an expansion chamber positioned longitudinally forward of the vectored flow nozzle. The vectored flow nozzle is configured to deflect expanding gases off the longitudinal axis and to divert the expanded gases along a new trajectory vertically downward relative to the longitudinal axis.

According to an embodiment, a recoil-reducing apparatus configured to be affixed to a muzzle of a gun having a gun barrel comprises a muzzle engagement recess configured to be positioned coaxial to and longitudinally forward of said gun barrel and an expansion chamber positioned longitudinally forward of the muzzle engagement recess. The expansion chamber comprises a front wall, a ceiling extending from the muzzle engagement recess to the front wall and comprising an internal flow mound proximal to said front wall, an anti-recoil surface extending from the front wall and facing the muzzle, a compression ramp extending longitudinally from the muzzle engagement recess to the anti-recoil surface, first and second lateral walls extending from the muzzle engagement recess to the front wall and from the ceiling to the compression ramp, and a departure recess defined in the front wall and positioned longitudinally forward of and coaxial to said gun barrel.

According to an embodiment, a recoil-reducing apparatus configured to be affixed to a muzzle of a gun having a gun barrel comprises a muzzle engagement recess configured to be positioned coaxial to and longitudinally forward of said gun barrel, an expansion chamber positioned longitudinally forward of said muzzle engagement recess, and a thrust beam spanning a width of the expansion chamber.

According to an embodiment, a recoil-reducing apparatus configured to be affixed to a muzzle of a gun having a gun barrel comprises a muzzle engagement recess configured to be positioned coaxial to and longitudinally forward of said gun barrel and an expansion chamber positioned longitudinally forward of said muzzle engagement recess. The expansion chamber comprises a front wall, a ceiling extending from the muzzle engagement recess to the front wall, an angled anti-recoil surface extending from the front wall and facing the muzzle, a compression ramp extending longitudinally from the muzzle engagement recess to the angled anti-recoil surface, first and second lateral walls extending from the muzzle engagement recess to the front wall and from the ceiling to the compression ramp, a departure recess defined in the front wall and positioned longitudinally forward of and coaxial to said gun barrel, and at least one port for exhaust gases to exit the expansion chamber.

DETAILED DESCRIPTION

Unconventional compensator designs, such as those featuring an asymmetric expansion chamber with a prominent anti-recoil surface, may allow gases to expand and, in doing so, strike a baffle surface and impart some force, which combats the gun's recoil indirectly. In this design, gases do not strike the baffle surface head-on, or rather, normal to the baffle's surface. Instead, gases strike the baffle surface at a glancing angle—this is highly inefficient, as more energy is transferred when gases strike normal to a counter-recoil surface. Leveraging the principles and insight gathered from studying fluid dynamics as it relates to firearms, specifically compressible supersonic and even hypersonic flow, it becomes readily apparent that massive levels of force, friction, velocity, heat, etc. are present. Where the gas flows, force and energy follow as well. Even what may seem like a somewhat small change in flow can yield vastly different results given the forces at work. That said, these traditional muzzle brake and compensator designs do not attempt to alter the primary vector of the escaping gases (i.e. straight forward) as they leave the muzzle. A need remains to be able to actively alter and influence the primary gas trajectory and redirect the gases onto a more direct collision course with a counter-recoil surface, thereby achieving a highly efficient degree of recoil reduction, and allowing for the compensator to take on both rearward recoil and muzzle climb (upward recoil) simultaneously.

Traditional muzzle brakes or compensators can obscure the shooter's field of view (i.e. the area directly vertically above the muzzle of a gun), blind them, redirect uncomfortable pressure waves back at them or to those in the immediate vicinity, or—even worse—give away the shooter's position to the enemy due to flash. These common downsides are major detractors when considering their use in combat. Muzzle flash is caused when under-oxygenated gases exit a gun barrel and are exposed to the cool air of the outer-atmosphere in such a way that the gases achieve a high ratio of volume to surface area. When a critical mass is reached and the cooler outside air interacts with the hot expanding gases of a gunshot, the gas becomes exposed to enough oxygen to allow for full combustion. Due to a high ratio of internal volume to surface area (for example, in the case of a shape such as a toroid or gas plume), the ignition happens all at once, resulting in a bright, conspicuous blast—similar to a thermobaric explosion. A need remains to be able to effectively accomplish both recoil reduction as well as flash reduction and back-blast reduction in such a way that all are accomplished effectively.

Figure 1:
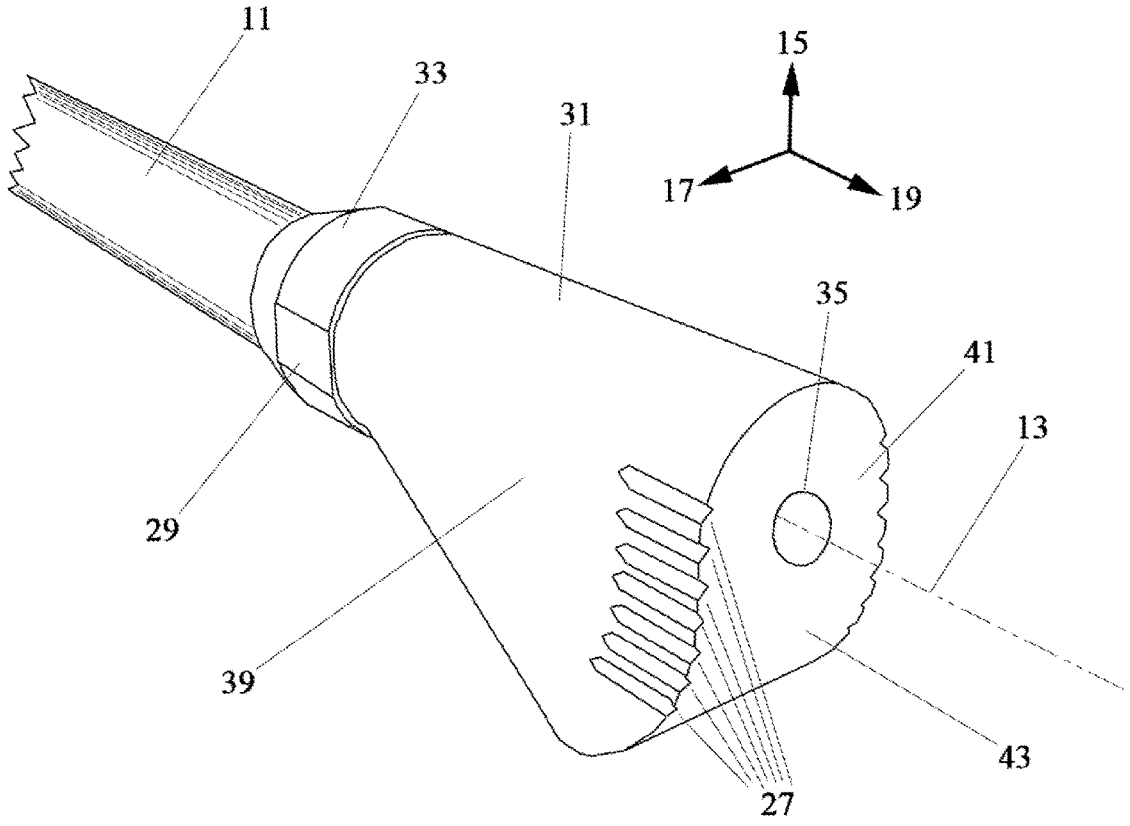
FIG. 1 shows a perspective view of the compensator affixed to the end of a gun barrel.

In FIG. 1, a gun barrel 11 having an axis 13 down the barrel's centerline is shown at a perspective view. To more clearly describe the compensator, an axes system is defined whereby the arrow at 15 indicates the vertical axis, the arrow at 17 indicates the lateral axis, and the arrow at 19 indicates the longitudinal axis. This embodiment of the compensator is affixed to the gun barrel 11 along its axis 13 via its muzzle engagement recess 33. The compensator is a coaxial extension of the gun barrel along the barrel's centerline axis. In this embodiment, the compensator's muzzle engagement recess 33 attaches to the gun barrel via threads (not shown) on the end of the gun. The engagement recess 33 is thus positioned coaxial to and longitudinally forward of the gun barrel 11. To better assist in installing the compensator, wrench flats 29 on the lateral sides of the muzzle engagement recess 33 are shown per an exemplary embodiment. Anatomically, this view also shows one of the side walls 39 on the lateral side of the compensator, along with horizontally elongated ports 27, the expansion chamber ceiling 31, curved primary anti-recoil surface 43, front wall 41, and the departure recess 35. The elongated ports 27 are substantially parallel to the ceiling 31 and their openings in terms of vertical height are ideally smaller than the diameter of the departure recess. The elongated ports 27 may be level (i.e. at 0° relative to the longitudinal axis 19) at their optimal angle so as not to, upon firing, impart any force on the gun barrel 11 that may add to muzzle climb due to gases escaping at a longitudinal angle, while also keeping gases out of the shooter's immediate field of view. Alternatively, the elongated ports 27 may be angled upward as even a small upward angle of +5° to +15° can assist in generating additional force to counter muzzle rise. Conversely, the elongated ports 27 may be angled slightly downward. For example, a downward angle of −5° to −15°, while suboptimal for counteracting muzzle rise, can nevertheless be employed to angle gases further away from the shooter's immediate field of view. While the elongated ports 27 are illustrated as being generally uniform, alternative embodiments may take the form of port arrangements with as few as one elongated port on each side of the planar side walls 39. Additionally, the elongated ports 27 may take the form of different lengths.

When the gun is fired, a projectile travels along the barrel's axis 13, passes through the compensator at the muzzle engagement recess 33 and exits the compensator at the departure recess 35. Expanding gases (not shown) take a very different path. The projectile's stability allows for virtually a straight trajectory along the barrel's centerline axis 13. The gases, on the other hand, leave the barrel 11, are deflected off of their forward trajectory along the barrel's centerline axis 13 by the vectored flow nozzle (not shown) and are diverted to their new trajectory that is longitudinally forward and vertically downward. This new trajectory diverts gases onto a more direct course with the curved primary anti-recoil surface 43, and exiting the compensator via the elongated ports 27 and, to a minor extent, also via the departure recess 35.

In terms of manufacturing materials, the compensator may be manufactured through additive means (such as 3D-printing) or via investment casting and welding. Furthermore, it is recommended that the disclosed anatomical parts of the compensator be integral with each other for strength, resulting in one solid item, and homogeneous in terms of the material used. Suitable materials may include steel, nickel-chromium alloys, titanium, cobalt chrome, or other sturdy metals.

Figure 2:
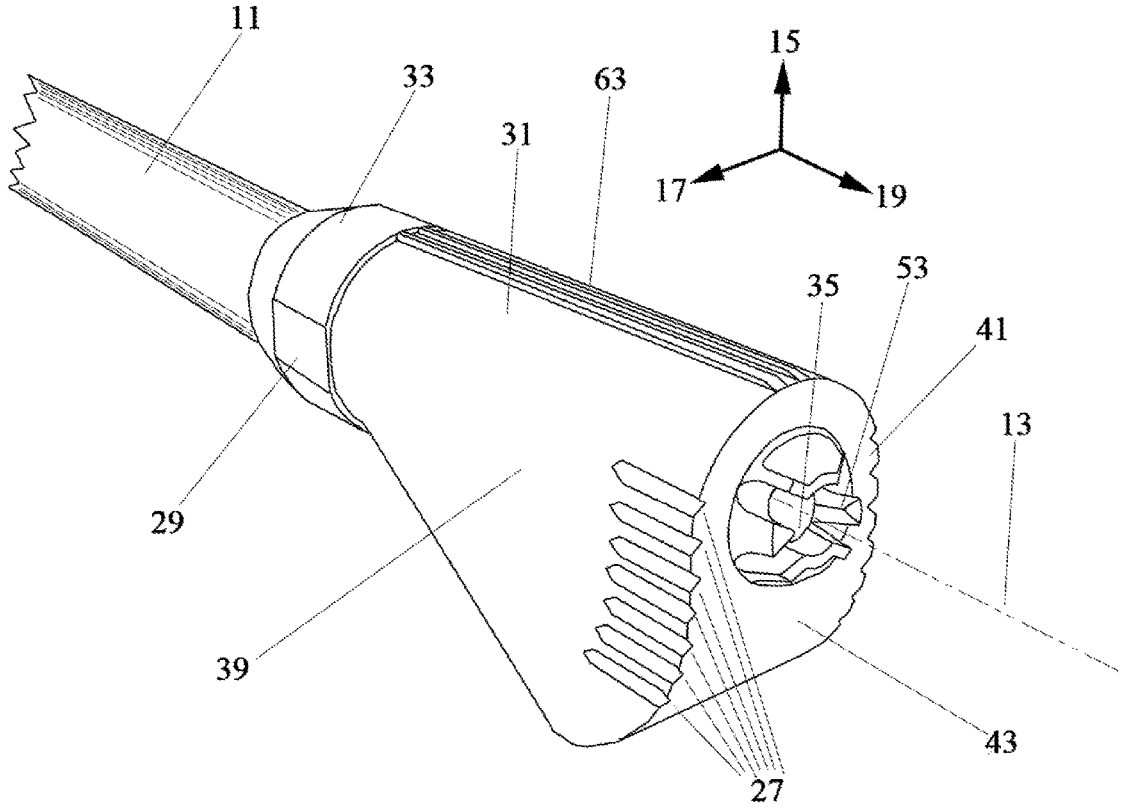
FIG. 2 shows a perspective view of the embodiment of the compensator displayed in FIG. 1 with additional features.

In FIG. 2, an exemplary embodiment to the compensator shown in FIG. 1 is illustrated. This embodiment additionally includes prongs 53 surrounding the departure recess 35. As some gases (not shown) exit via the departure recess 35, they expand into the prongs 53 and break apart, preventing a gas plume and minimizing flash. Furthermore, this embodiment of the compensator includes orientation bars 63 defined on the ceiling 31 of the expansion chamber. These orientation bars 63 serve to assist in installing the compensator on a barrel 11 in a straight, level manner. For instance, the orientation bars 63, when at the 12 o'clock position, confirm the compensator is orientated in the correct vertical position, thereby allowing the compensator to work as designed. The orientation bars 63, thus, act as a visual cue, allowing a user looking at the compensator to quickly determine the compensator's position (i.e. whether it is off-center or not).

Figure 3:
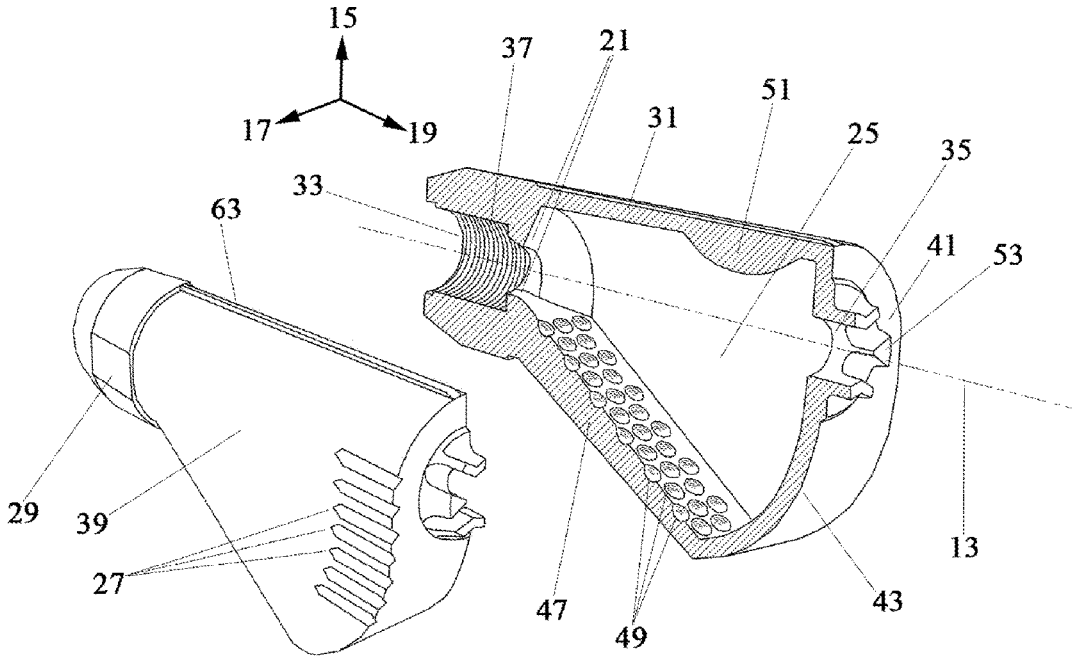
FIG. 3 shows an exploded view of the compensator's embodiment displayed in FIG. 2.

FIG. 3 shows an exploded view of the embodiment of the compensator seen in FIG. 2 in the form of two longitudinally-cut halves. This view provides insight in to the inner workings of the compensator. The threads 37 defined in the muzzle engagement recess 33 are now visible. The vectored flow nozzle 21 lies longitudinally forward of the threads 37 and the muzzle engagement recess 33. The vectored flow nozzle 21 is integral to the compensator and connects the muzzle engagement recess 33 to the rest of the compensator, acting as a gateway to the expansion chamber 25. In terms of its dimensions, the vectored flow nozzle's walls surround the barrel's axis 13 and come in very close proximity to the projectile (not shown) when it passes through the compensator along the barrel's axis 13. The vectored flow nozzle 21 is placed very closely to the end of the gun barrel (not shown) due to the threads 37 in the muzzle engagement recess 33 attaching to the end of the gun barrel (not shown), thereby placing the vectored flow nozzle 21 very close to, but not attached to, the gun barrel. The gun barrel (not shown) engages via the threads 37 and upon firing, expels hot, expanding gases (not shown) longitudinally forward and vertically level along the barrel's axis 13 until it reaches the vectored flow nozzle 21, at which point, the gases change course to flow vertically downward and longitudinally downward as they enter the expansion chamber 25. After gases change their primary trajectory to one with a downward angle, the downward angle of the gases increases as they rush past the compression ramp 47. In this embodiment, a plurality of dimples 49 is defined on the surface of the compression ramp 47. The compression ramp 47 acts as an anti-recoil surface, pushing the gun barrel down when gases strike it. The compression ramp dimples 49 increase the surface area of the compression ramp, induce drag on the gases rushing past them (thereby acting as their own counter-recoil surfaces), and draw gases closer to the surface of the compression ramp 47. The net effect is more gases on a direct collision course with the curved primary anti-recoil surface 43 and therefore more counter-recoil force generated by the compensator. Furthermore, the vectored flow nozzle 21, assisted by the dimples 49 on the compression ramp 47, allows for a decrease in flash produced by the compensator because gases no longer simply follow the barrel's axis 13 and exit via the departure recess 35.

Figure 4:
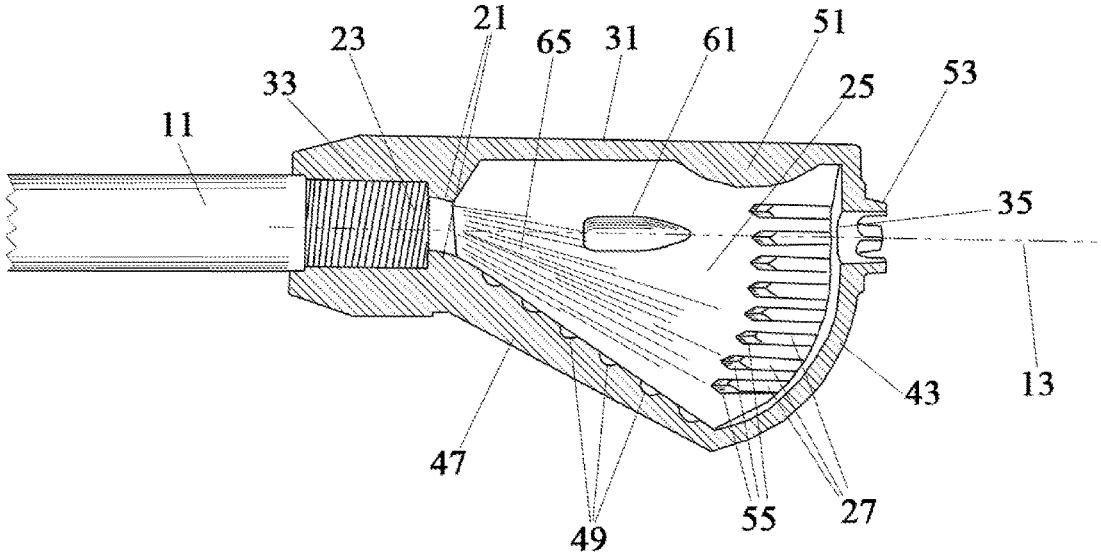
FIG. 4 shows a sectional view of an embodiment of the compensator in FIG. 3.

FIG. 4 shows a sectional view of the embodiment of the compensator from FIG. 3 affixed to a threaded gun muzzle 23, allowing a more clear view of the vectored flow nozzle 21. As depicted, the vectored flow nozzle very clearly is angled to guide gas flow 65 forward and downward, yet allow a clear, straight path for a projectile 61 to pass through the compensator without deviating from its trajectory along the barrel's axis 13. As stated previously, the vectored flow nozzle 21 is integral to the rest of the compensator and dictates the downward angle of gas flow 65 into the expansion chamber 25. As the projectile 61 passes through the compensator, it passes through the vectored flow nozzle 21 within very close proximity to each other; this tight tolerance allows the vectored flow nozzle to engage with the gas flow 65 before it has a change to really expand. Optimally, the inner diameter of the vectored flow nozzle will be very comparable if not equal to the diameter of the exit recess 35, which is only slightly larger than the diameter of the projectile 61. Furthermore, optimally, the downward angle of the walls of the vectored flow nozzle 21 ranges from −15° to −30° from the barrel's axis 13. The larger the projectile 61 caliber is, the steeper the recommended downward angle of the vectored flow nozzle becomes so as to prevent gases from exiting a therefore physically larger departure recess 35. Furthermore, steeper downward angles in the walls of the vectored flow nozzle 21 impart more counter-recoil forces due to more gas flow 65 striking the curved primary anti-recoil surface 43. Gases 65 flow along their new trajectory, are deflected downward more as they rush past the dimples 49 on the compression ramp 47, at which point gases proceed to strike the curved primary anti-recoil surface 43 and exit via the elongated ports 27. The port bleed ramps 55, defined in the elongated ports 27, are angled surfaces that further vector gases diagonally (i.e. laterally outward and longitudinally forward) away from the shooter so as to minimize any concussion or flash experienced.

Figure 5:
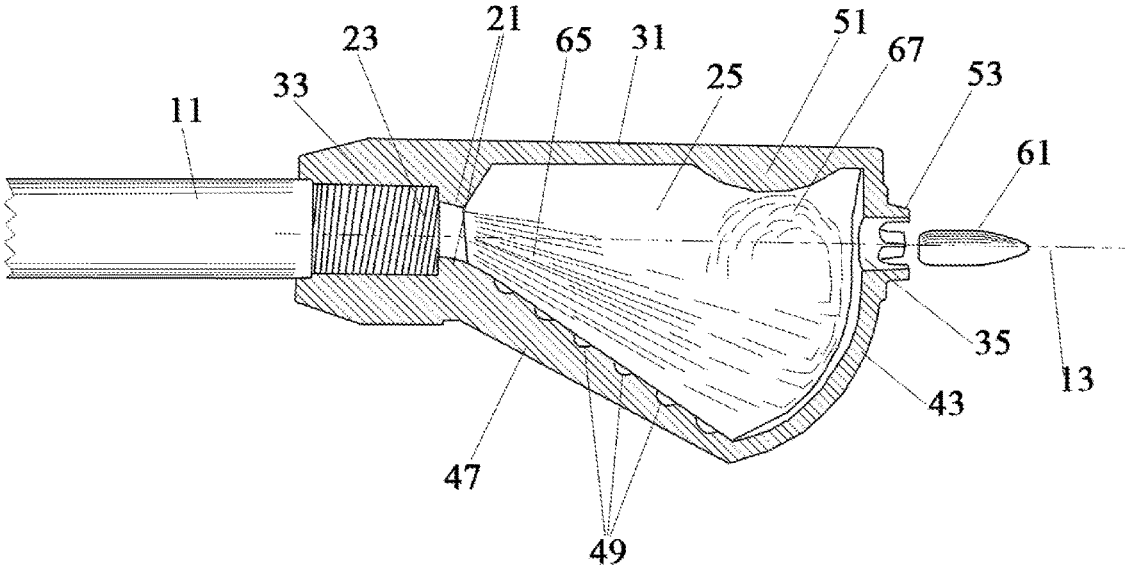
FIG. 5 shows the sectional view of the embodiment of the compensator from FIG. 4 illustrating gas flow.

FIG. 5 shows the sectional view of the embodiment of the compensator from FIG. 4 once gas strikes the curved primary anti-recoil surface 43. The elongated ports (not shown) and port bleed ramps (not shown) are only omitted from this figure to illustrate the interaction of the eddy 67 within the compensator. Some gas flow 65 forms an eddy 67 and circles within the compensator. To minimize this, an internal flow mound 51, defined in the expansion chamber's ceiling 31 and being in close proximity to the front wall 41, reduces the maximum diameter the eddy 67 can become while also leaving clearance for the projectile 61, thereby minimizing the potential for increased flash during rapid firing. The internal flow mound 51 extends vertically downward from the ceiling 31 in close proximity to the projectile 61 as it passes through the expansion chamber 25. In an exemplary embodiment, the flow mound 51 may be as close as a few one hundredths of an inch—it may be as close as possible without risking possible contact with the projectile, taking into account the manufacturing tolerances for both, the compensator as well as the projectile. In its preferred embodiment, the integral flow mound 61 extends vertically downward to be level to the upper portion of the departure recess 35.

Figure 6:
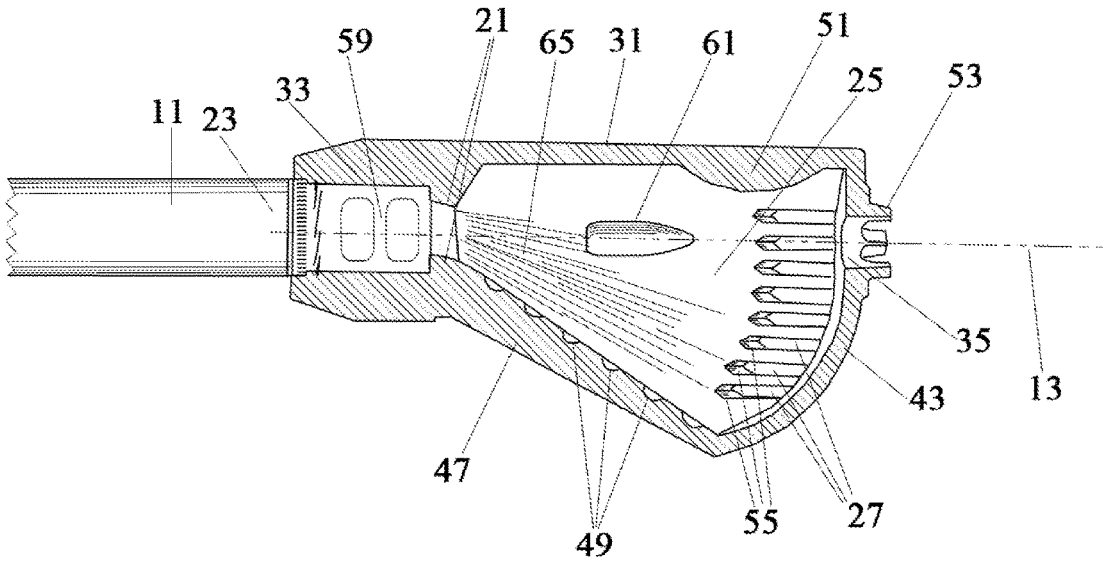
FIG. 6 shows a sectional view of an alternate embodiment of the compensator from FIG. 4 with a modified means of attachment to the gun barrel.

FIG. 6 shows a sectional view of an alternate embodiment of the compensator from FIG. 4 with a modified means of attachment to the gun barrel 11. This embodiment attaches over an existing muzzle device 59 where the muzzle engagement recess 33 connects via a quick-detach mount 57 and functions in otherwise the same manner as the embodiment of the compensator shown in FIG. 4. For the purpose of clarity, an example of an existing muzzle device 59 is a traditional muzzle brake featuring a quick-detach mount 57 allowing itself to be affixed to the gun barrel 11.

Figure 7:
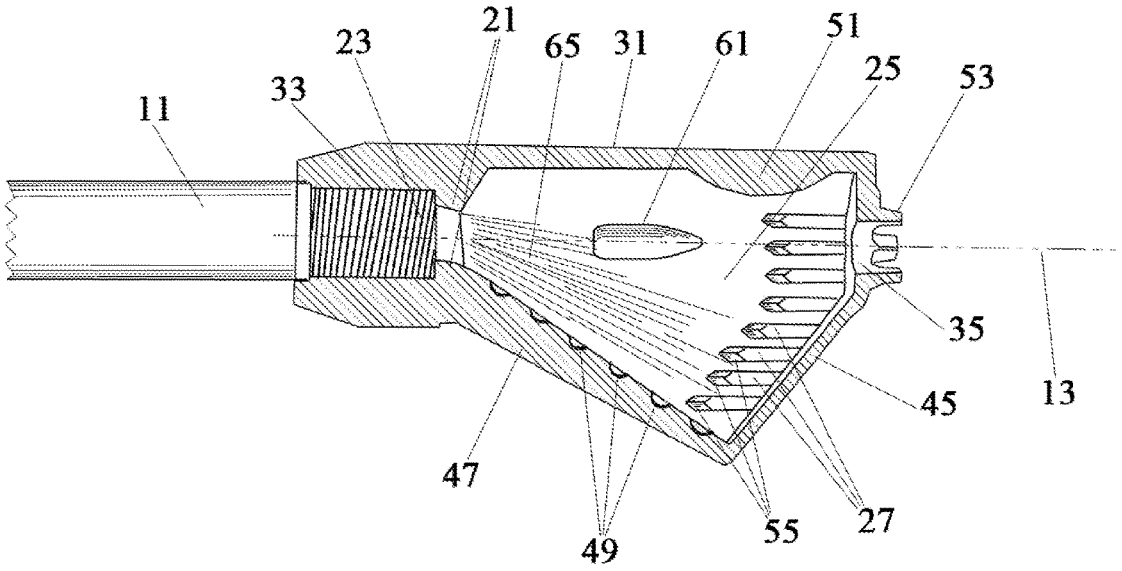
FIG. 7 shows a sectional view of an alternate embodiment of the compensator in FIG. 4 with an angled anti-recoil surface.

FIG. 7 shows a sectional view of an alternate embodiment of the compensator from FIG. 4 featuring a flat primary anti-recoil surface 45. The flat primary recoil surface provides gas flow 65 the opportunity to strike a substantially planar surface angled to be perpendicular to its trajectory, resulting in the generation of a sharp impulse of anti-recoil force and is angled relative to the longitudinal axis of the gun barrel 11.

Figure 8:
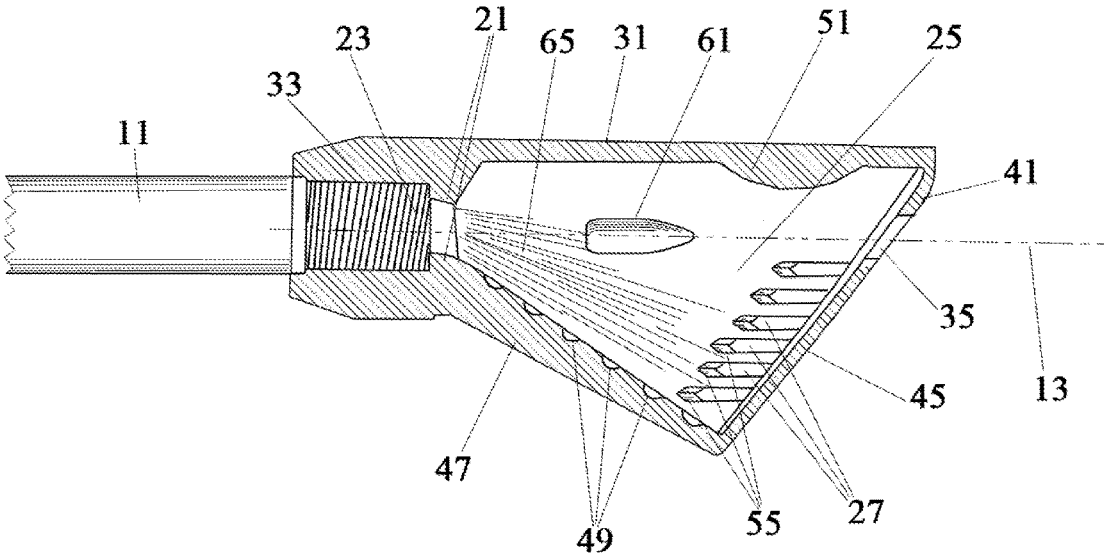
FIG. 8 shows a sectional view of an alternate embodiment of the compensator in FIG. 7 with an angled front wall.

FIG. 8 shows a sectional view of yet another embodiment of the compensator from FIG. 4 featuring an angled front wall 41 that joins the angled flat primary anti-recoil surface 45. This configuration angles the front wall 41 with the angled flat primary anti-recoil surface 45 to maximize the total surface area perpendicular to the gas flow 65 due to the aiming of these gases by the vectored flow nozzle 21.

Figure 9:
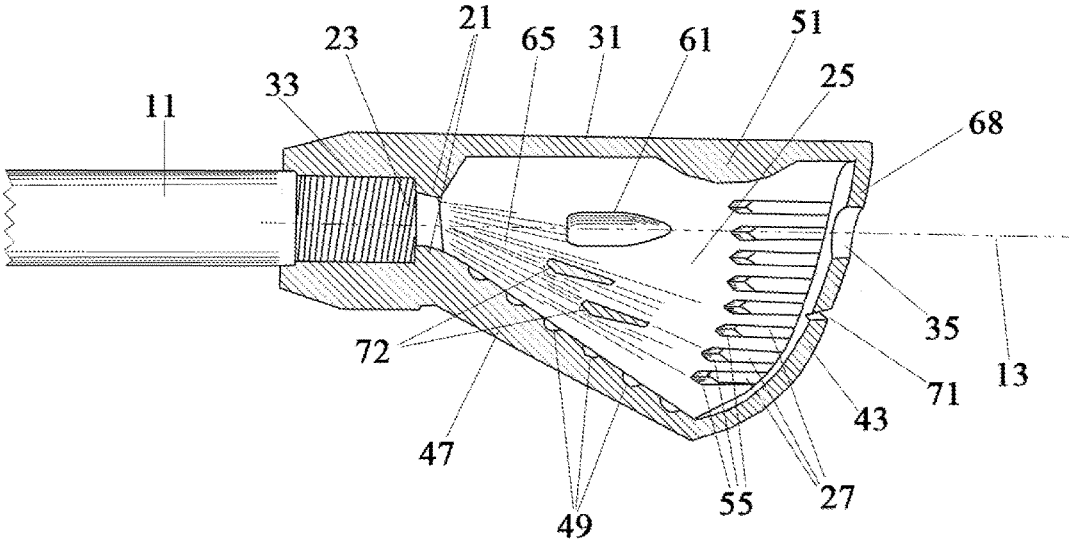
FIG. 9 shows a sectional view of an alternate embodiment of the compensator in FIG. 5 with a curved front wall, interior thrust beams, and a forward facing vent.

FIG. 9 shows a sectional view of an alternate embodiment of the compensator in FIG. 5 a curved front wall 68 that joins the curved primary anti-recoil surface 43, thereby catching and cradling gas flow 65 in a way that provides a downward force and therefore further decreases muzzle climb. FIG. 9 also features a plurality of interior thrust beams 72, which serve to redirect the trajectory of the gas flow 65 to maximize the effectiveness of the curved primary anti-recoil surface 43. The interior thrust beams 72 within the expansion chamber 25 span the lateral width of the chamber, provide structural integrity and act as an additional surface for the gas flow 65 to strike against. In an exemplary embodiment, the interior thrust beams 72 are substantially wing-like in appearance and structure, being relatively flat, having a relatively thin cross-section, and able to influence the path of gas flow 65. The curved front wall 68 naturally allows for maximum surface area when catching expanding gases from the gas flow 65 that may be traveling along the barrel axis 13 and departing from the intended downward trajectory due to the aiming of these gases by the vectored flow nozzle 21. Furthermore, this alternate embodiment also features a forward-facing vent 71 defined in the curved primary anti-recoil surface 43 allowing the gas flow 65 to exit the compensator substantially forward. In this illustration, the forward-facing vent 71 is angled slightly upward to allow gas flow 65 exiting the compensator to impart a downward force further mitigating muzzle rise.

Figure 10:
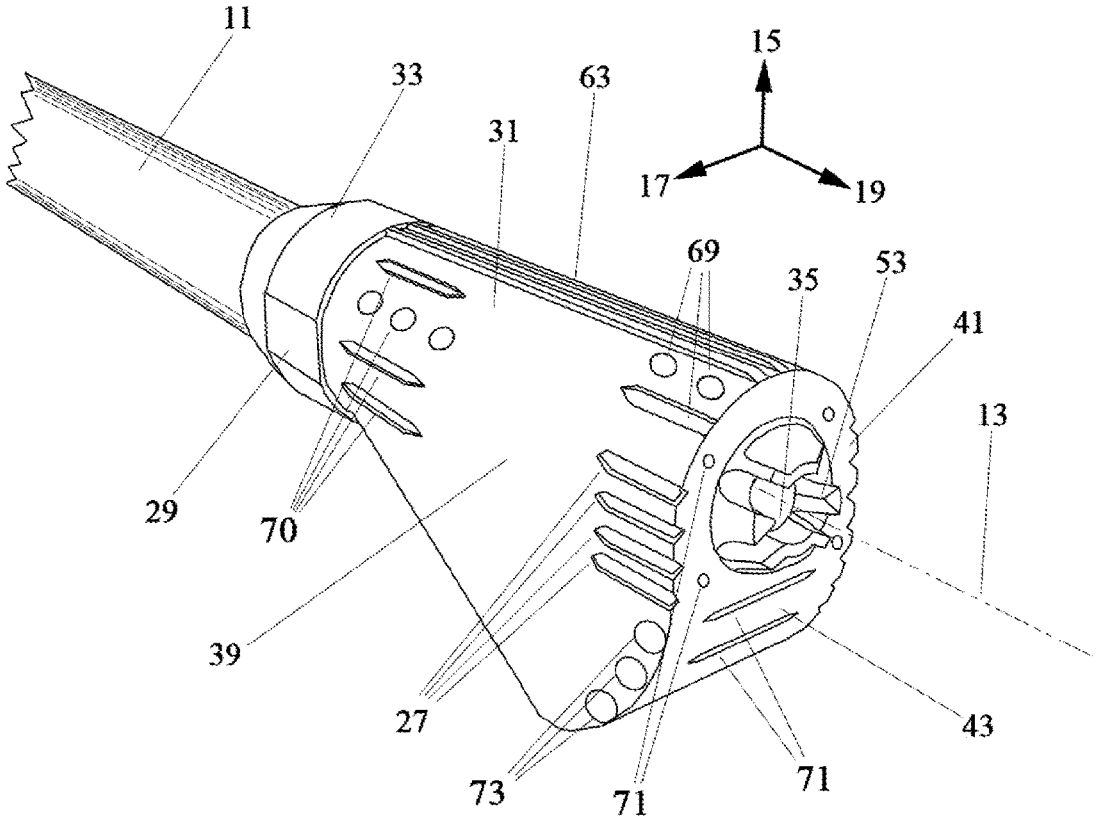
FIG. 10 shows a perspective view of an alternate embodiment of the compensator displayed in FIG. 1 with alternative port arrangements.

FIG. 10 displays a perspective view of an alternate embodiment of the compensator in FIG. 1 featuring various porting configurations. Elongated ports 27 can be seen on the side walls 39 of the compensator alongside 73 non-elongated wall ports. These different port types can work together forming a synergy between the two types, wherein non-elongated wall ports 73 allow for gas flow (not shown) to be aimed, generating more force to counter recoil and lower the compensator's internal pressure, elongated ports 27 allow for flash reduction and concussion mitigation. In addition to these, vertical ports 69 can be seen proximal to the front wall 41. Furthermore, ports that are distant from the front wall 41, hereafter referred to as distal ports 70, can be seen someone proximal to the muzzle engagement recess 33. Distal ports 70 allow gas flow to exit in a way allowing for a lower internal pressure within the compensator while also introducing oxygen into the compensator, limiting flash, lowering recoil, and mitigating muzzle rise. Furthermore, several forward-facing vents 71 can be seen defined in the curved primary anti-recoil surface 43. These forward-facing vents 71 provide another means of reducing pressure within the compensator but also may provide muzzle climb reduction as well.

Figure 11:
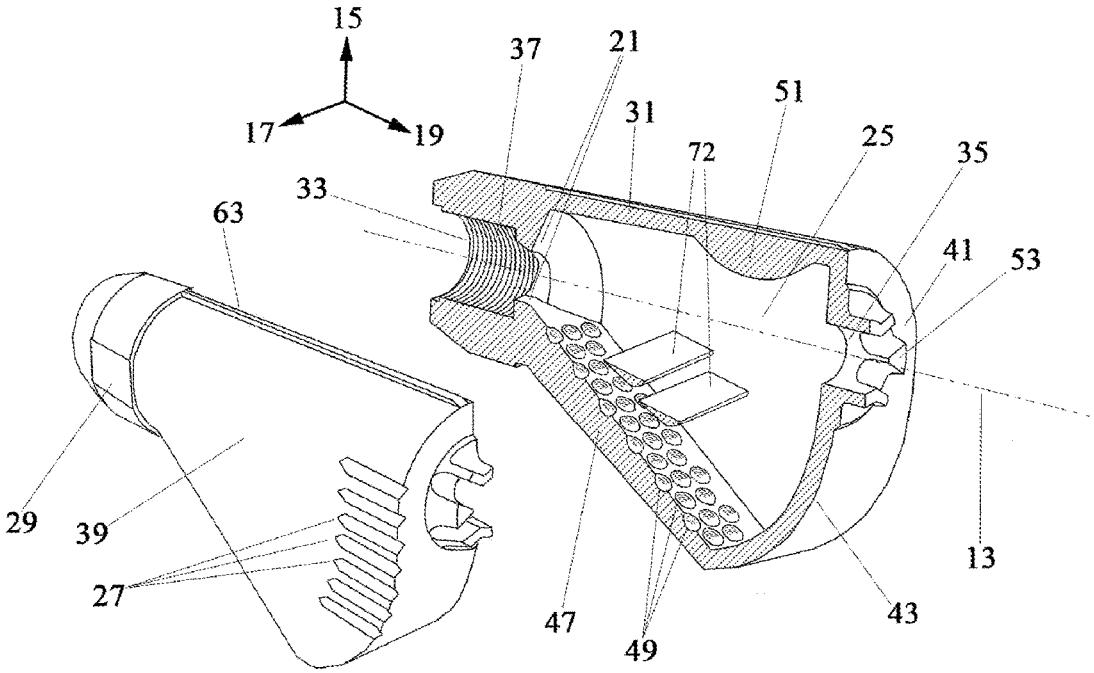
FIG. 11 shows an exploded view of an alternate embodiment of the compensator displayed in FIG. 3 featuring an interior thrust beam.

FIG. 11 displays an exploded view of an alternate embodiment of the compensator in FIG. 3 featuring a plurality of interior thrust beams 72. This three dimensional, exploded view provides additional insight in terms of the preferred positioning of the interior thrust beams 72 positioned within the expansion chamber 25.

Various embodiments of invention are described below.

A recoil-reducing apparatus configured to be affixed to a muzzle of a gun having a gun barrel, wherein the apparatus comprises: a muzzle engagement recess configured to be positioned coaxial to and longitudinally forward of said gun barrel; a vectored flow nozzle positioned coaxial to and longitudinally forward of said muzzle engagement recess; an expansion chamber positioned longitudinally forward of said vectored flow nozzle comprising: a front wall; a ceiling extending from the muzzle engagement recess to the front wall; an angled anti-recoil surface extending from the front wall and facing the muzzle; a compression ramp extending longitudinally from the vectored flow nozzle to the flat anti-recoil surface; first and second lateral walls extending from the vectored flow nozzle to the front wall and from the ceiling to the compression ramp; a departure recess defined in the front wall and positioned longitudinally forward of and coaxial to said gun barrel and said vectored flow nozzle; and a plurality of approximately horizontal elongated ports defined in the first and second lateral walls proximal to the flat anti-recoil surface, wherein the expansion chamber defines an asymmetric internal volume expanding downward relative to the longitudinal axis of the gun barrel; and/or Said compression ramp includes a plurality of surface dimples; and/or A plurality of prongs are positioned longitudinally forward of and in close proximity to said departure recess; and/or Said muzzle engagement recess engages said muzzle via threads on said gun barrel; and/or Said muzzle engagement recess engages an existing muzzle device on said gun barrel via a quick-detach mount; and/or Said ceiling in said expansion chamber further comprises an internal flow mound proximal to said front wall; and/or Said approximately horizontal elongated ports further comprise bleed ramps; and/or Said front wall is angled.

A recoil-reducing apparatus configured to be affixed to a muzzle of a gun having a gun barrel, wherein the apparatus comprises: a muzzle engagement recess configured to be positioned coaxial to and longitudinally forward of said gun barrel; a vectored flow nozzle positioned coaxial to and longitudinally forward of said muzzle engagement recess; an expansion chamber positioned longitudinally forward of said vectored flow nozzle comprising: a front wall; a ceiling extending from the muzzle engagement recess to the front wall; a curved anti-recoil surface extending from the front wall and facing the muzzle; a compression ramp extending longitudinally from the vectored flow nozzle to the curved anti-recoil surface; first and second lateral walls extending from the vectored flow nozzle to the front wall and from the ceiling to the compression ramp; a departure recess defined in the front wall and positioned longitudinally forward of and coaxial to said gun barrel and said vectored flow nozzle; and a plurality of approximately horizontal elongated ports defined in the first and second lateral walls proximal to the curved anti-recoil surface, wherein the expansion chamber defines an asymmetric internal volume expanding downward relative to the longitudinal axis of the gun barrel; and/or Said compression ramp includes a plurality of surface dimples; and/or A plurality of prongs are positioned longitudinally forward of and in close proximity to said departure recess; and/or Said muzzle engagement recess engages said muzzle via threads on said gun barrel; and/or Said muzzle engagement recess engages an existing muzzle device on said gun barrel via a quick-detach mount; and/or Said ceiling in said expansion chamber further comprises an internal flow mound proximal to said front wall; and/or Said approximately horizontal elongated ports further comprise bleed ramps; and/or Said front wall is angled.

Although the description above contains many specificities, these should not be construed as limiting the scope of embodiments but as merely providing illustrations of some of several embodiments. Different embodiments may include different combinations of one or more disclosed features.

While at least one exemplary embodiment of the present invention(s) is disclosed herein, it should be understood that modifications, substitutions and alternatives may be apparent to one of ordinary skill in the art and can be made without departing from the scope of this disclosure. For instance, while the illustrations and the associated descriptions may include different aspects of the invention, one or more features may be omitted in a given embodiment without departing from the scope of the invention. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

DRAWINGS—REFERENCE NUMERALS

11 gun barrel
13 barrel axis
15 vertical axis

17 lateral axis
19 longitudinal axis
21 vectored flow nozzle
23 gun muzzle
25 expansion chamber
27 elongated ports
29 wrench flats
31 ceiling
33 muzzle engagement recess
35 departure recess
37 threads
39 side wall
41 front wall
43 curved primary anti-recoil surface
45 angled primary anti-recoil surface
47 compression ramp
49 compression ramp dimples
51 internal flow mound
53 prongs
55 port bleed ramps
57 quick-detach mount
59 Existing muzzle device
61 projectile
63 orientation bars
65 gas flow
67 eddy
68 curved front wall
69 vertical ports
70 distal ports
71 forward-facing vent
72 interior thrust beam
73 non-elongated wall ports

The invention claimed is:

1. A recoil-reducing apparatus configured to be affixed to a muzzle of a gun having a gun barrel having a longitudinal axis, the apparatus comprising: a muzzle engagement recess configured to be positioned coaxial to and longitudinally forward of said gun barrel; a vectored flow nozzle having an angled throat, wherein said vectored flow nozzle is adjacent to said muzzle engagement recess and positioned coaxial to and longitudinally forward of said muzzle engagement recess; and an expansion chamber positioned longitudinally forward of said vectored flow nozzle, wherein the expansion chamber defines an asymmetric internal volume expanding downward relative to the longitudinal axis of the gun barrel; and wherein the vectored flow nozzle is configured to deflect expanding gases away from the longitudinal axis and to divert the expanded gases along a new trajectory vertically downward relative to the longitudinal axis and restrict said expanded gases from traveling along a trajectory vertically upward relative to the longitudinal axis.

2. The apparatus of claim 1, wherein the expansion chamber comprises:

a front wall;
a ceiling extending from the muzzle engagement recess to the front wall;
an anti-recoil surface extending from the front wall and facing the muzzle;
a compression ramp extending longitudinally from the vectored flow nozzle to the anti-recoil surface;
generally planar first and second lateral walls extending from the vectored flow nozzle to the front wall and from the ceiling to the compression ramp;
a departure recess defined in the front wall and positioned longitudinally forward of and coaxial to said gun barrel and said vectored flow nozzle.

3. The apparatus of claim 2, wherein the anti-recoil surface is either curved or flat.

4. The apparatus of claim 2, further comprising a plurality of approximately horizontal elongated ports defined in the first and second lateral walls proximal to the anti-recoil surface.

5. The apparatus of claim 2, further comprising one or more of:

a non-elongated port defined in the first and second laterals walls;
a vertical port defined in the ceiling proximal to the front wall;
a vertical port defined in the ceiling proximal to the muzzle engagement recess; and
a forward-facing vent defined in the anti-recoil surface.

6. The recoil-reducing apparatus of claim 2, wherein said compression ramp includes a plurality of surface dimples.

7. The recoil-reducing apparatus of claim 2, further comprising a plurality of prongs positioned longitudinally forward of and in proximity to said departure recess.

8. The recoil-reducing apparatus of claim 1, wherein said muzzle engagement recess is configured either:

to engage said muzzle via threads on said gun barrel; or
to engage an existing muzzle device on said gun barrel via a quick-detach mount.

9. The recoil-reducing apparatus of claim 2, wherein said ceiling further comprises an internal flow mound proximal to said front wall.

10. The recoil-reducing apparatus of claim 3, wherein said approximately horizontal elongated ports further comprise bleed ramps.

11. The recoil-reducing apparatus of claim 2, wherein said front wall is angled.

12. The apparatus of claim 1, wherein the angled throat has a longitudinal axis oriented at a predetermined tinge relative to the longitudinal axis of the gun barrel.

13. The apparatus of claim 12, wherein the predetermined angle ranges from about −15° to about −30°.

14. The recoil-reducing apparatus according to claim 1, the apparatus further comprising:

a thrust beam spanning a width of the expansion chamber.

15. The apparatus of claim 14, wherein the thrust beam has a shape of an inverted airfoil.

16. The apparatus of claim 14, wherein the expansion chamber comprises:

a front wall;
a ceiling extending from the muzzle engagement recess to the front wall;
an anti-recoil surface extending from the front wall and facing the muzzle;
a compression ramp extending longitudinally from the muzzle engagement recess to the anti-recoil surface;
first and second lateral walls extending from the muzzle engagement recess to the front wall and from the ceiling to the compression ramp;
a departure recess defined in the front wall and positioned longitudinally forward of and coaxial to said gun barrel; and
a forward facing vent defined in the anti-recoil surface and angled upward.

17. The recoil-reducing apparatus according to claim 1, the apparatus further comprising:

a departure recess defined in the front wall and positioned longitudinally forward of and coaxial to said gun barrel; and at least one port for exhaust gases to exit the expansion chamber.

* * * * *